US006804621B1

(12) United States Patent
Pedanckar

(10) Patent No.: US 6,804,621 B1
(45) Date of Patent: Oct. 12, 2004

(54) METHODS FOR ALIGNING MEASURED DATA TAKEN FROM SPECIFIC RAIL TRACK SECTIONS OF A RAILROAD WITH THE CORRECT GEOGRAPHIC LOCATION OF THE SECTIONS

(75) Inventor: Niranjan Ramesh Pedanckar, Pune (IN)

(73) Assignee: Tata Consultancy Services (Division of Tata Sons, LTD), Pune (IN)

( * ) Notice: Subject to any disclaimer, the term of this patent is extended or adjusted under 35 U.S.C. 154(b) by 0 days.

(21) Appl. No.: 10/412,364

(22) Filed: Apr. 10, 2003

(51) Int. Cl.[7] ..... G06F 19/00
(52) U.S. Cl. ..... 702/94; 702/85
(58) Field of Search ..... 33/287, 338; 104/178; 356/246; 702/94, 150, 152, 153, 85

(56) References Cited

U.S. PATENT DOCUMENTS

| | | | | | |
|---|---|---|---|---|---|
| 1,980,035 | A | * | 11/1934 | Cardew et al. | 246/121 |
| 3,041,982 | A | * | 7/1962 | Plasser et al. | 104/7.1 |
| 3,314,154 | A | * | 4/1967 | Plasser et al. | 33/1 Q |
| 3,505,742 | A | * | 4/1970 | Fiechter | 33/338 |
| 3,517,307 | A | * | 6/1970 | Wallen, Jr. et al. | 324/662 |
| 3,857,183 | A | * | 12/1974 | Plasser et al. | 33/523 |
| 3,864,039 | A | * | 2/1975 | Wilmarth | 356/625 |
| 3,882,607 | A | * | 5/1975 | Plasser et al. | 33/523 |
| 4,005,601 | A | * | 2/1977 | Botello | 73/146 |
| 4,036,594 | A | * | 7/1977 | Ibing et al. | 422/255 |
| 4,075,888 | A | * | 2/1978 | Buhler | 73/146 |
| 4,274,334 | A | * | 6/1981 | Lund | 104/2 |
| 4,367,681 | A | * | 1/1983 | Stewart et al. | 104/7.2 |
| 4,391,134 | A | * | 7/1983 | Theurer et al. | 73/146 |
| 4,417,466 | A | * | 11/1983 | Panetti | 73/105 |
| 4,497,255 | A | * | 2/1985 | Theurer | 104/8 |
| 4,573,131 | A | * | 2/1986 | Corbin | 702/168 |
| 4,655,142 | A | * | 4/1987 | Theurer et al. | 104/7.1 |
| 4,658,730 | A | * | 4/1987 | von Beckmann et al. | 104/8 |
| 4,691,565 | A | * | 9/1987 | Theurer | 73/146 |
| 5,007,349 | A | * | 4/1991 | Theurer | 104/12 |
| 5,040,122 | A | * | 8/1991 | Neukirchner et al. | 701/207 |
| 5,107,598 | A | * | 4/1992 | Woznow et al. | 33/521 |
| 5,113,767 | A | * | 5/1992 | Theurer | 104/7.2 |
| 5,127,333 | A | * | 7/1992 | Theurer | 104/2 |
| 5,203,089 | A | * | 4/1993 | Trefouel et al. | 33/338 |
| 5,255,066 | A | * | 10/1993 | Jager | 356/141.2 |
| 5,301,548 | A | * | 4/1994 | Theurer | 73/146 |
| 5,331,745 | A | * | 7/1994 | Jager | 33/651.1 |
| 5,353,512 | A | * | 10/1994 | Theurer et al. | 33/523.2 |
| 5,481,982 | A | * | 1/1996 | Theurer et al. | 104/7.2 |
| 5,605,099 | A | * | 2/1997 | Sroka et al. | 104/2 |
| 5,787,815 | A | * | 8/1998 | Andersson et al. | 105/199.2 |
| 5,791,063 | A | * | 8/1998 | Kesler et al. | 33/651 |
| 5,978,717 | A | * | 11/1999 | Ebersohn et al. | 701/19 |
| 6,064,428 | A | * | 5/2000 | Trosino et al. | 348/128 |

(List continued on next page.)

FOREIGN PATENT DOCUMENTS

| | | | | | |
|---|---|---|---|---|---|
| CA | 2113128 | A | * | 7/1994 | E01B/33/00 |
| GB | 2372569 | A | * | 8/2002 | B61K/9/10 |

*Primary Examiner*—John Barlow
(74) *Attorney, Agent, or Firm*—Donald R. Boys; Central Coast Patent Agency, Inc.

(57) ABSTRACT

A method for aligning measured track data collected from a railroad track to correct geographic location information for geometric parameters in the measured track data includes steps for (a) obtaining track geography data for use as reference data in data alignment; (b) reconstructing the track geography data to simulate in form and in coverage of length the measured track data to be aligned, (c) comparing the reconstructed reference data to the measured track data to identify a relative misalignment value between the data types; and (d) using the value identified through comparison to correct the geographic location information contained in the measured track data.

33 Claims, 6 Drawing Sheets

U.S. PATENT DOCUMENTS 6,154,973 A * 12/2000 Theurer et al. ..... 33/651
6,189,224 B1 * 2/2001 Theurer et al. ..... 33/338
6,218,961 B1 * 4/2001 Gross et al. ..... 340/903
6,347,265 B1 * 2/2002 Bidaud ..... 701/19
6,356,299 B1 * 3/2002 Trosino et al. ..... 348/128
6,373,403 B1 * 4/2002 Korver et al. ..... 340/988
6,397,130 B1 * 5/2002 Carr et al. ..... 701/19
6,415,522 B1 * 7/2002 Ganz ..... 33/523.1
6,480,766 B2 * 11/2002 Hawthorne et al. ..... 701/19
6,637,703 B2 * 10/2003 Matheson et al. ..... 246/124
6,681,160 B2 * 1/2004 Bidaud ..... 701/19
6,697,752 B1 * 2/2004 Korver et al. ..... 702/116
2002/0077733 A1 * 6/2002 Bidaud ..... 701/19

* cited by examiner

METHODS FOR ALIGNING MEASURED DATA TAKEN FROM SPECIFIC RAIL TRACK SECTIONS OF A RAILROAD WITH THE CORRECT GEOGRAPHIC LOCATION OF THE SECTIONS

FIELD OF THE INVENTION

The present invention is in the field of railroad track engineering and maintenance, including preventive and proactive care, and pertains more particularly to methods for aligning rail measured track data with correct geographic location of the sections from which the data was measured.

BACKGROUND OF THE INVENTION

In the field of railroad engineering and maintenance, proactive maintenance of rails comprising the tracks of a railroad is extremely important for insuring safe operation of trains on the tracks. Gage widening (increase in separation between left and right rails), rail wear, fatigue-induced cracks, and other conditions have the potential to cause harmful consequences such as train derailments. Therefore, state-of-art methods are used to inspect track conditions at regular intervals along geographic sections of railroad, the sections comprising the entire length of a given line.

Special track geometry measurement vehicles known in the art as "Geocars" are available to the inventor for measuring and thus enabling acquisition of important information about the condition of railway tracks along a line. Measurements that are important in proactive maintenance of a line include such as gage parameters, alignment parameters, curvature parameters, cross-level parameters, surface quality parameters, wear parameters, and so on.

Through ongoing track analysis, track degradation problems can be identified and located. By comparing old sets of data with newer sets of data along a same set of tracks, certain degradation problems can be predicted. Predicting the behavior of track degradation can be useful in planning proactive maintenance actions. Typically, analyzing and extrapolating the behavior of track measurement data taken from subsequent test vehicle runs recorded on different dates, provides maintenance authorities with information that enables one or more predictions indicative of what type of proactive maintenance should be initiated and when it should be initiated.

A requirement of the method described immediately above is that the geographic locations of measured data has to be known within a reasonable accuracy so that data from different test runs on different test dates can be compared consistently and behavior can be projected in a future sense. Some track measuring systems have geographic data provided through the use of the well-known Global Positioning System (GPS). However most existing system do not have this advantage, partly because of expense, and therefore must rely on older methods for acquiring geographic location information to aid in locating specific measured characteristics. Even with the use of GPS, geographic position results may still not be reasonable accurate for exactly pinpointing potential problems.

In the case of the systems that do not have access to GPS, the most critical problem encountered in performance of track degradation analysis is the unavailability of correct geographic location references for track measurement data recorded on different test dates. With these systems geographic location information is acquired manually by the vehicle test operator or other authorized persons by measuring distances from planted mileposts, for example. Such measurements are approximate at best. At times a geographic location assessment is made before arriving at a planned test location, or after passing the test location. An error margin of as much as 250 feet is typical in relating a geographic location to an actual test site where specific measurements were taken under such circumstances.

Other factors can cause misalignment of geographic location to test-sites, such as odometer malfunctions of a particular test vehicle and inconsistencies of odometer performance from vehicle to vehicle. For example, odometer readings are typically used to update location information for test sites. If a particular odometer of a test vehicle has a calibration error resulting in inaccurate measurement results, then the amount of error increases with distance traveled. Error in calibration can result in a standard measurement unit, for example, a foot or a meter, to be recorded longer or shorter than the actual measure. Multiplied error over distance can be as much as 50 feet misalignment in a mile or so distance. Moreover, different vehicles used to test a same length of track on different dates may have differing calibration errors, states of wheel wear, or wheel slip conditions resulting in further inconstancies. The problem can be further affected by human error. Automatic Location Detectors are available for many railroads and are used to mark and identify geographic location of track measurement data, however these detectors are often not reliably picked up by passing test vehicles and those that are detected still do not provide enough data for correct data alignment.

A system for locating a vehicle along a length of railroad track is known to the inventor and described in U.S. Pat. No. 5,791,063 hereinafter '063. This system includes pre-measuring track geometry along the length of a railroad track and then storing this information in a historical data repository. As a vehicle moves along the same length of track having a historical geometry, the vehicle creates a real-time version of the same data and then the data is compared in order to pinpoint location of the vehicle. The described method relies on GPS positioning and previously aligned track data for reference.

A similar method is also known to the inventor and is referenced in a publication (http://ece.caeds.eng.uml.edu/Faculty/Rome/rail/trbjand,pdf) and was presented at the Sixth International Heavy Haul Railway Conference—"Strategies Beyond 2000", 6–10 Apr. 1997, Cape Town, South Africa. This known method uses an estimation technique based on an extended Kalman filter to recursively align track geometry data. The method and apparatus of the recursive system comprises an expensive turnkey system, which may in some embodiments also rely on GPS positioning. This method uses previously aligned data as a reference and cross-correlates new measured data against the reference or previously aligned data. It attempts to align the data using an extended Kalman filter based on the similarity of gage and cross-level signatures that are retained by the track over time. The method also requires previously aligned track data as a reference.

In light of the limitations in the prior art it has occurred to the inventor that a more economical solution is needed for finding correct geographic location of track measurement data through intelligently comparing it with track geography data that is already available in record. Track geography data information for tracks laid by a railroad is available, for example, as a part of a Roadway Information System (RIS) database and includes information such as curvature and super-elevation of curved portions of tracks.

Therefore, what is clearly needed is a method and apparatus that can be used to identify features in track measurement data that can be matched against those same features available in the track geography data of record. A system such as this could accurately locate detected problems and abnormalities in a large length of track in an automated fashion without reliance on historical alignment data or GPS positioning systems and therefore could be provided more economically and practically.

SUMMARY OF THE INVENTION

In a preferred embodiment of the present invention a computerized system for aligning measured track data collected from a length of railroad track to correct geographic location information for geometric features contained in the data is provided, comprising a first data repository containing track geography data, a second data repository containing the measured track data, and a processing component for comparing the measured track data to the track geography data. The system is characterized in that the track geography data is reconstructed to match in format and track length to the measured track data and then compared as reference data to the measured track data, the comparison made in whole and or in matching portions thereof for purpose of identifying shift in alignment between the data types, the shift relating to misalignment of geometric and geographic signatures present in both data types including shift identified as odometer error value in the measured track data, the identified shifts used to correct geometric, geographic, and odometer error misalignment in the measured track data with respect to the reference data.

In some preferred embodiments the system is maintained in and accessible from a track-geometry test vehicle and in others it is maintained externally from but accessible in part to a track-geometry test vehicle. In still other embodiments the geometric data used for alignment comprises one or a combination of curvature data, cross-level data, gage data, super-elevation data, rail twist data, and rough feature location information.

In yet other embodiments the track geography data is available from and taken from a known Railway Information System data repository. In yet others the method for comparing the measured data against the reference data is cross-correlation. In some cases the measured track data after shift correction may subsequently be used as previously aligned data for reference used in further alignment of data recorded at a later date over the same track length. In others data reconstruction of the track geography data includes data reformatting to simulate the data format of the measured track data. I still others data reconstruction of the track geography data includes segmentation to produce segments of track geography data representing data occurring over a specified track length. In still other cases shift in alignment due to odometer error is identified through linear regression.

In another aspect of the invention a method for aligning measured track data collected from a railroad track to correct geographic location information for geometric parameters in the measured track data is provided, comprising steps of (a) obtaining track geography data for use as reference data in data alignment; (b) reconstructing the track geography data to simulate in form and in coverage of length the measured track data to be aligned; (c) comparing the reconstructed reference data to the measured track data to identify a relative misalignment value between the data types; and (d) using the value identified through comparison to correct the geographic location information contained in the measured track data.

In some preferred embodiments of the method, in step (a), the track geography data is available from and taken from a known Railway Information System data repository. In other preferred embodiments, in step (a), the track geography data may contain feature location information and at least some if not all data types describing curvature data, cross-level data, gage data, and super-elevation data.

In still other embodiments of this method, in step (b), the track geography data is reconstructed to produce segments of track geography data representing data occurring over a specified track length including geometric data of features and feature location information located along the specified length. In yet other embodiments, in step (c), the method for comparison is cross-correlation and the primary parameter to be compared is curvature data. In yet other embodiments, in step (c), the method for comparison is cross-correlation and the primary parameter to be compared is super-elevation.

In yet other embodiments of this method, in step (c), the method for comparison is cross-correlation and the primary parameter to be compared is cross-level measurement. In still others, in step (c), the method for comparison is cross-correlation and the primary parameter to be compared is gage measurement. While in yet others, in step (b), the track geography data lacks curvature information of curves contained therein and the reconstruction thereof uses the ratio between super-elevation and curvature data to predict type direction and magnitude of curves. In still other embodiments, in step (b), track geography data may be divided into segments of pre-determined track lengths using a constrained optimization algorithm wherein the total length of segments not satisfying geometric constraints is minimized over a length of track for alignment consideration.

In yet another aspect of the present invention, in a data alignment process for aligning measured track data collected along a length of railroad track to a reference data set for the same length of track, a method for coarse estimation of odometer error manifest along the track length of measured track data and refining the coarse estimate to produce a final estimate used in correcting the actual odometer error manifest in the measured track data is provided, comprising steps of (a) creating a plurality of simulated data sets from the measured track data, each data set simulating a different odometer error value, each value taken at a different predetermined interval point along a predetermined maximum error range applied to the measured track data set, the range having a zero interval point at center thereof; (b) cross-correlating each of the simulated data sets against the reference data set at each interval point along the maximum range allowed obtaining a coefficient value for each of the simulated data sets; (c) identifying a single best coefficient value from those obtained in step (b) that defines a best alignment to data contained in the reference data set; and (d) repeating steps (a) through (c) using a smaller range having smaller intervals, the smaller range centered over the range interval in the first range of the measured track data associated the best coefficient identified.

In some embodiments, in step (a), the error shifts are created by shrinking the measured track data to produce shift intervals along the negative side of the range and stretching the data to produce shift intervals along the positive side of the range. In other embodiments, in step (a), shrinking the measured track data is accomplished by deleting a record from the data at uniform intervals a number of times until a desired amount of shrinking is produced and stretching the measured track data is accomplished by duplicating a record in the data at uniform intervals a number of times until a desired amount of stretching is produced. In yet other embodiments, in step (a), the maximum shift range exceeds maximum odometer error manifestation possible for the specified length of the track measured. While in still others, in step (b), the coefficient values define linear association strength between correlating interval points along the range.

In yet other embodiments, in step (c), the single coefficient value produces a coarse odometer error value. In still others, in step (d), the best coefficient found after correlating all of the simulated data sets of the smaller range intervals against the reference data set produces a final odometer error estimate for the measured track data set.

In still another aspect of the invention, in a data alignment process for aligning measured track data collected along a length of railroad track to a reference data set for the same length of track, a method for estimating a value of odometer error manifest along the track length of measured track data is provided, comprising steps of (a) cross-correlating the entire set of measured track data to the entire set of reference data to identify a relative misalignment value; (b) filtering the measured track data set to remove references to certain geometric features; (c) dividing the length of the measured and reference data sets into smaller portions; (d) cross-correlating the smaller portions of measured data against associated portions of reference data to find relative misalignment values for each portion; (e) using line regression, fitting a line through the found misalignment values plotted sequentially for each correlated data portion on a graph; and (f) determining the magnitude and direction of slope of the fitted line indicative of the magnitude and direction of the actual calibration error manifest in the measured track data.

In some embodiments of this method, in step (a), the reference data comprises previously aligned measured track data aligned to track geography data as reference data. In other embodiments, in step (a), geometric features and location information contained in both data sets are used to align the data sets. In yet others, in step (b), the geometric data references removed describe curvature data and those retained describe one or both of cross-level features and gage measurement features. In still others, in step (d), the geometric parameter for alignment is cross-level measurement.

In some cases of this method, in step (d), the geometric parameter for alignment is gage measurement, and in others, steps (a) through (f) may be carried out in batch mode using multiple measured track data sets as input and a same previously aligned data set as reference data for a same length of track, each measured track data set collected at different test runs performed at different times.

BRIEF DESCRIPTION OF THE DRAWING FIGURES

Description of the Preferred Embodiments

The inventor provides a unique method and system for utilizing generally available track geography data to locate the correct geographic location of track measurement data taken along a path of railroad track, in absence of previously aligned track measurement data, and/or GPS position data. The methods and apparatus of the present invention are described in enabling detail below.

Figure 1:
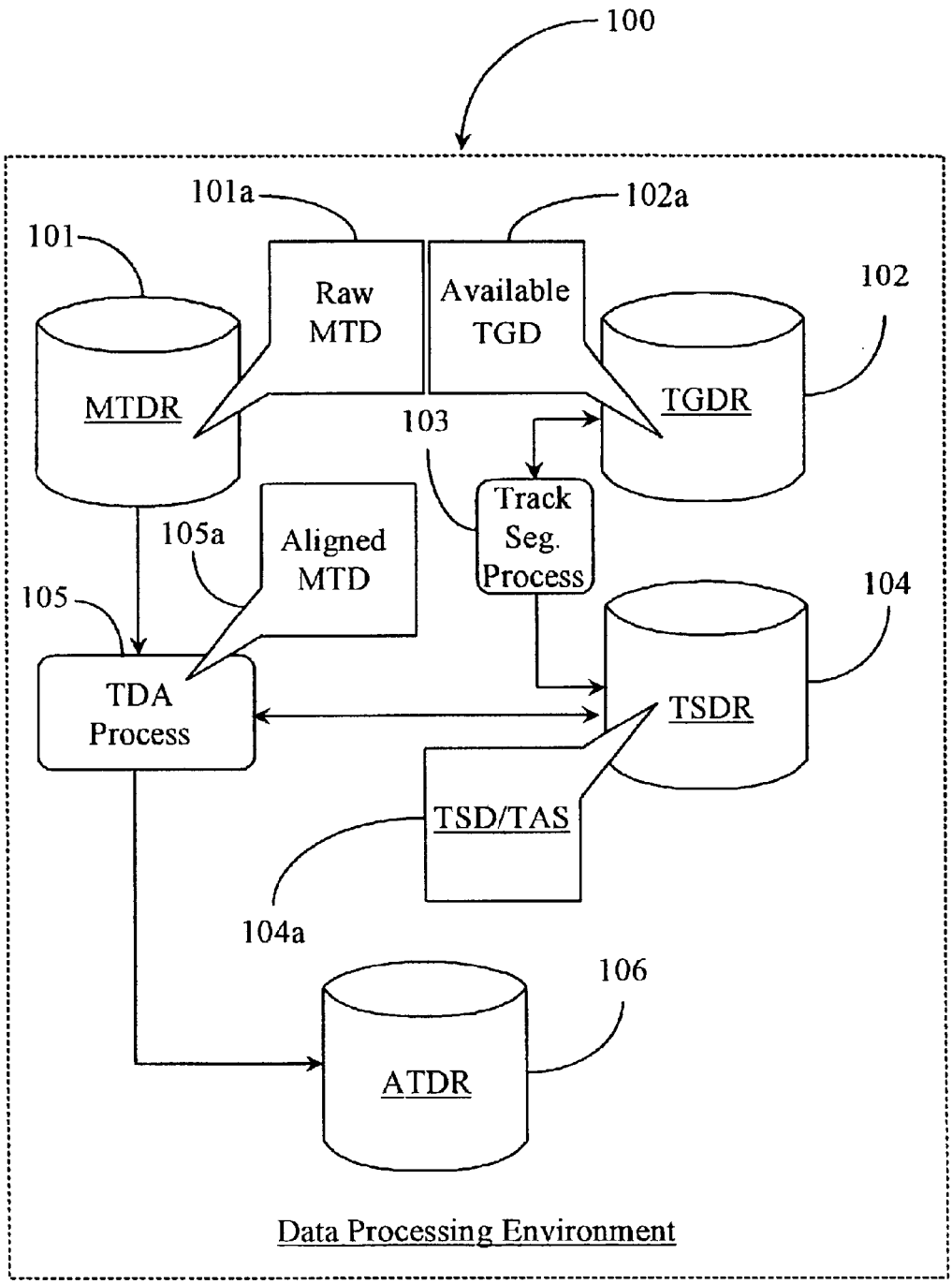
FIG. 1 is a block diagram illustrating a track-data alignment process and a track segmentation process according to an embodiment of the present invention.

FIG. 1 is a block diagram illustrating a data processing environment and system 100, including a track-data alignment process 105 conducted in parallel with a track segmentation process 103 according to an embodiment of the present invention. Data processing environment and system 100 is provided for the purpose of aligning correct geographical location with measured track data along a path of railroad track, the track data taken primarily from a measurement test vehicle or a railroad car adapted for the purpose.

In a preferred embodiment data processing environment 100 is borne on such a vehicle as described above, however this is not required in order to practice the present invention. For example, environment 100 can be a distributed environment that involves multiple data storage locations connected together through a data network accessible to a test measurement vehicle.

Environment 100 has a "measured track data repository" (MTDR) 101 accessible thereto. Repository 101 can be an optical storage drive, a disk drive, a magnetic drive, or any other suitable repository for storing track data. Raw measured track data (MTD) 101*a* is compiled along specific lengths of track on one or more test operations and is stored in MTDR 101 for later access. In one embodiment MTDR 101 is provided as a central data server enabled with appropriate database access software, and raw MTD 101*a* is written to portable CD-ROM disks when collected during test measuring, and later input or copied from CDs into the repository. In this embodiment, repository 101 may be maintained at a remote location from an actual test vehicle or vehicles involved in compilation of test data. In another embodiment, test data is automatically converted into a suitable data format and entered into an on-board version of MTDR 101, the data in which may be later uploaded into a main MTDR repository. There are many configuration possibilities.

Raw MTD 101*a* may include, but is not limited to, track geometry parameters like track curvature measurements, cross-level measurements, track or rail twist measurements, super-elevation measurements, track alignment measurements such as gage, and rail surface measurements. MTD 101*a* also includes rough track location information taken by such as manual methods and/or distance marker recognition techniques (automatic location detection) for each point along a length of track where MTD 101*a* is collected. It is duly noted herein that one object of the invention is to correct the geographic location information contained in MTD in terms of its align ability to actual test locations where data measurements were taken.

Data processing environment 100 has a track geography data repository (TGDR) 102 accessible thereto, or in some embodiments provided therein. Repository 102 may be any type of repository as described with reference to repository 101 above. Likewise, TGDR 102 may be remote from but accessible to environment 100. Repository 102 is adapted to store available track geography data (TGD) 102*a*. TGD 102*a* is readily available to the inventor from the Roadway Information System (RIS). Track geography data maintained by RIS includes data such as track layouts, details of track features such as track curves, road crossings, and switches. TGD further includes track curvature information, geographic locations of beginning and end points of track curves, direction of track curves, type of track curves and track super-elevation data. In a preferred embodiment, TGD 102*a* is previously taken in desired portions (corresponding to MTD from specific track lengths) from the RIS repository and deposited in TGDR 102 as TGD 102*a* in the proper and supported format.

As was described above, a primary object of the invention is to provide a method to intelligently use available track geography data to locate the correct geographic location of track measurement data, in absence of previously aligned track measurement data or GPS positioning data. The measure of misalignment in any two one-dimensional data sets can be obtained by using a mathematical technique called cross-correlation. Cross-correlation involves use of a mathematical formula for sliding a test data set across a reference data set, obtaining a measure for the degree of match between the two data sets, and finding the relative shift between the sets where the match is maximized. Using this technique, a measure of misalignment is found with respect to a reference containing appropriate geographic location information for a given track measurement data set to be aligned. Thus, the given data set can be assigned its correct geographic reference information. In the prior-art this is accomplished using a previously aligned data set as a reference data set.

In a preferred embodiment of the present invention MTD 101*a* taken on a particular test run by a track measurement vehicle is aligned using cross-correlation-based methods against a reference data set that is constructed artificially from TGD 102*a*. However, there are processes that must be performed on TGD 102*a* in order to render it useable as reference data according to embodiments of the present invention.

One process that must be performed on TGD 102*a* is referred to herein as a track segmentation process and given the element number 103 in this example. Track segmentation process 103 involves defining specific segments of track having representative length and having a specific beginning point and a specific end point. Such defined segments contain geometric attributes from TGD 102*a* that occur along the given length of each segment. In a preferred embodiment, the defined segments of data are large enough for useful comparison in cross-correlation, yet small enough to be processed using automated comparison tools using reasonable computer processing power. The exact data size of each segment of length is determined by the presence of identifiable and described features within each segment. Moreover, exact segment length is uniform from segment to segment, and length can be determined in real time for specific lengths of tracks that are subject to test measuring at the time.

Track segments defined in process 103 are also termed herein as track aligned segments (TASs). TASs created from TGD 102*a* are entered into a track segment data repository TSDR 104. TSDR 104 can be of any type of repository as was described with reference to repository 101 and 102 above. In one embodiment repositories 101, 102, and 104 may be segregated portions of a large single repository centrally located for data access and processing. TSDR 104 stores track segment data (TSD) 104*a* in the form of linearly ordered geometric data sets representing a particular segment of track.

It is noted herein and is an object of the present invention to include only features of TGD 102*a* that are useable and comparable with features of MTD 101*a* when track segmentation process 103 is performed. It is also noted that features of a type contained within each track segment must be sufficient in number for comparison following a basic constraint criteria as follows:

Each segment shall contain a minimum number of features of type for comparison purposes.

Each segment shall contain at least one whole feature of type.

Each segment shall represent a track length less than a maximum allowable limit.

Each segment shall represent a track length greater than a minimum allowable limit.

There are a number of possible track geography features that can be Included in TSD 104*a* for comparison. One particularly useful feature, and one that is used according to a preferred embodiment of the invention, is track curvature data. It is noted herein, however, that other features may be included in track segmentation process 103 instead of or in combination with curvature data. The inventor uses curvature data as an optimal feature because curvature is a feature that has prominent signature characteristics for cross-correlation, and processing can be streamlined by minimizing track segmentation of data that contains little or no curvature data or otherwise does not fit the constraints applied to track segmentation. However, in another embodiment described further below, other track features play a part in comparison during cross-correlation procedures.

Using curvature data as comparison criteria, then each defined track segment (TAS) containing TSD 104*a* according to the constraints listed above and according to a preferred embodiment, contains a minimum of two curves and a maximum of eight curves. Also, the length of each segment preferably is greater than a mile and less than 10 miles. However, exact constraint parameterization may vary accordingly and any exact parameters cited herein should not be construed as a limitation in any way.

In one embodiment, using curvature data as a signature vehicle, process 103 only defines a TAS if the constraint criteria for the TAS will be met. In another embodiment TASs are defined linearly from all of the available TGD, but segments determined later not to meet geometric criteria are then discarded from consideration in processing. It is noted herein that in another process consideration, process 103 can be achieved for a given length of track through optimized algorithmic method wherein the object constrained by, in this case, feature constraint parameters of curvature data, is "minimization of length of track segments without suitable features". Algorithmic optimization while providing the best track coverage is more difficult to implement while sequential processing is more simply implemented, but may be heuristic and sub-optimal.

Once sufficient MTD 101*a* and TSD 104*a* is available for a specific length of track considered, correlation processes can commence. Data processing environment 100 uses a track data alignment process illustrated herein as a (TDA) process 105 for correlating track data and performing, as a sub process, alignment of correct geographic location to measured track data. TDA process 105 takes MTD 101*a* from MTDR 101 as input and selects appropriate TSD 104*a* (a TAS) from TSDR 104 as data input wherein correlation and alignment is performed using automated tools. Process 105 produces aligned measured track data (MTD) illustrated herein as aligned MTD 105*a*. Aligned MTD 105*a* takes the form of an aligned segment of length prescribed by the defined length of selected TSD 104*a*. Aligned data sets are entered into a data repository provided for the purpose illustrated herein as an aligned track data repository (ATDR) 106.

ATDR 106 is analogous in physical description to previously mentioned data repositories 101, 102, and 104 and in fact may be included with the aforementioned in a single central server. In another embodiment ATDR 106 is maintained in a separate machine. In one embodiment of the present invention, aligned MTD 105*a* is retained and used in later test operations as previously aligned reference data to correlate against new test data measured over the same track locations at later dates. In this way condition-change analysis can be performed to quickly identify any potential track degradations that may occur over time providing a proactive method for identifying problems quickly and with pinpoint geographic accuracy.

It will be apparent to one with skill in the art of data correlation that the example of processing environment 100 contains processes that can be further defined in terms of sub processes including additional steps for practicing the invention without departing from the spirit and scope of the invention. These sub processes are assumed contained in or optionally accessible to the overall process implied in this example, each sub process containing both optional and required processing steps or paths that will be described in further detail below. The overall process described with respect to processing environment 100 can be used on all track lengths where testing is performed without requiring previously aligned data as reference data or expensive GPS functionality.

Track Data Alignment

Track data alignment (TDA) is the process of aligning measured data against reference data to reveal a misalignment value representing a shift in alignment that has to be corrected after identification including refining of geographic information connected to the data.

Figure 2:
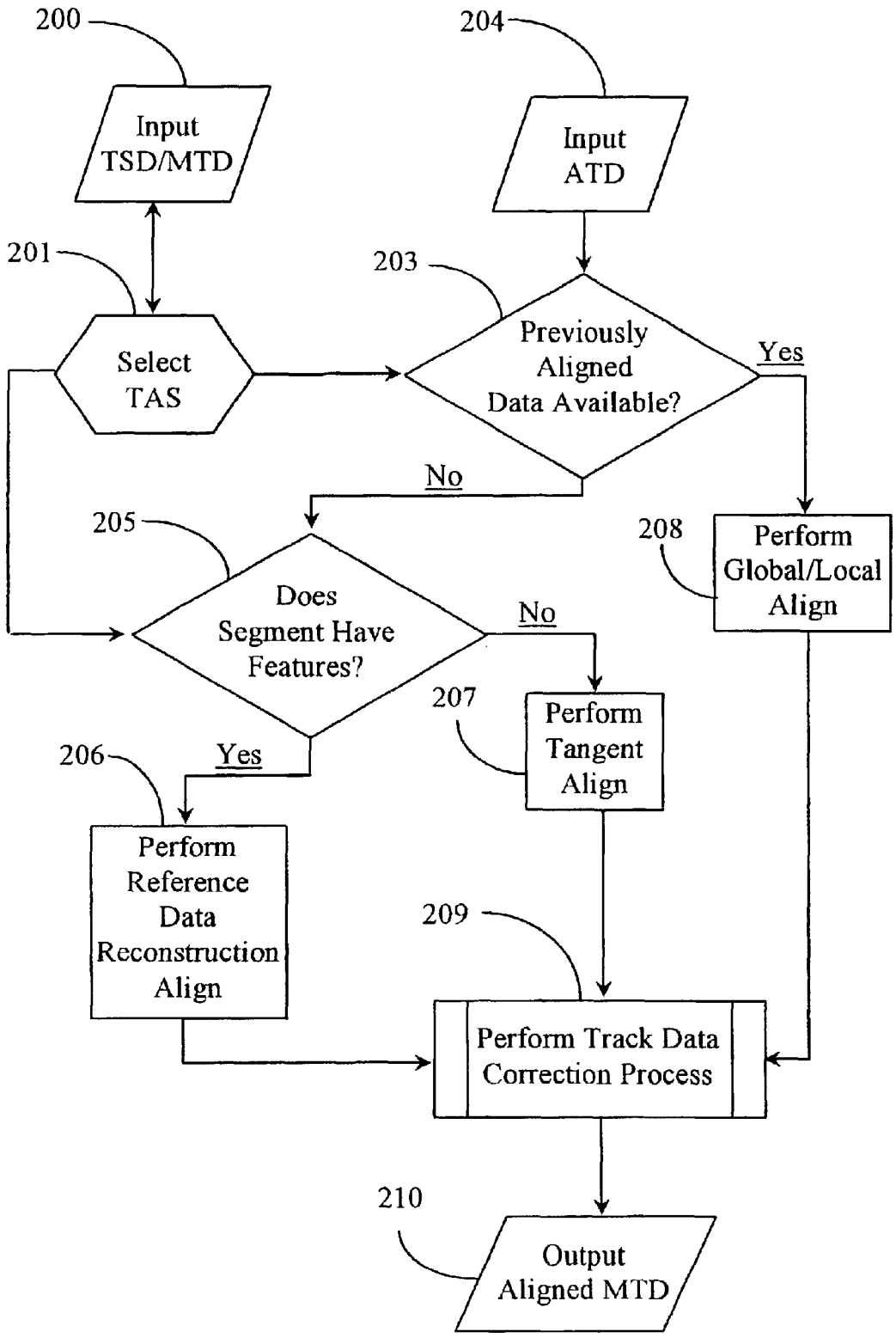
FIG. 2 is a process flow chart illustrating steps for aligning track data according to an embodiment of the present invention.

FIG. 2 is a process flow chart illustrating steps for performing the track data alignment process 105 of FIG. 1 according to an embodiment of the present invention. As was described with reference to FIG. 1 above, TDA process 105 is used to cross-correlate raw MTD 101*a* with TSD 104*a* in units of TAS to refine geography location information of measured data sets.

It is noted herein, and should be apparent so far in this specification, that there are numerous acronyms used to describe various data processes and types. For this reason and for the purpose of simplifying dissemination of the disclosure of the present invention certain acronyms that have already been introduced with complete names will from time to time be re-identified throughout this specification with the complete name with the acronym, in order that retention of meaning is simplified.

At step 200 TSD analogous to TSD 104*a* is made available to the process from a repository analogous to track segment data repository (TSDR) 104 described with reference to FIG. 1. At step 201 an appropriate track alignment segment (TAS) is selected based on initial location information for processing. Selection based on location information means simply that rough location information in the segment is compared with known information in the length of track under consideration. It is assumed in this embodiment that raw MTD (101*a* FIG. I) is already input into the TDA process and the selected TAS containing TSD geographically matches the MTD, at least in empirical consideration in terms of roughly matching a beginning point in data alignment.

A TAS is analogous to a particular segment containing geometric TSD including geographic location information. A method for processing is also selected from more than one offered methods for processing during initial TDA processing. For example, at step 203 it is determined whether or not there is any previously aligned track data (ATD) available that matches the selected TAS and covers the length of track considered. This is accomplished at step 203 by searching for any ATD made available as data input at step 204 from a repository analogous to aligned track data repository (ATDR) 106 described with respect to FIG. 1 above. From this point in the data alignment process, there are two possible processing paths selection of which depends on presence of available ATD for the selected segment. If it is determined at step 203 that there is not ATD present for the length of track represented by a particular TAS selected at step 201, then at step 205 it is determined whether the selected TAS has the required geometric features in sufficient number according to the process constraints. This embodiment assumes that all track aligned segments (TAS) are created contiguously from available track geography data (TGD) and then checked according to the geometric constraint criteria instead of only creating segments that have the required geometric features as was described as one embodiment with respect to segmentation process 103 introduced in the example of FIG. 1.

At step 205 of the data alignment process, if the segment has the required type and number of features, then at step 206 a reference data reconstruction alignment process 206 is performed as the preferred TDA process. The use of process 206 to align data depends on a negative determination at step 203 and a positive determination at step 205. Process 206, which has sub-processes not illustrated in this example but described further below, aligns raw MTD with TASs that have sufficient features for alignment and wherein no previously aligned track data (ATD) is available. Step 206 reconstructs the geographic data for any given TAS into a continuous data record having the same granularity of measurement as the raw track measurement data (MTD) taken in the field as test data. In actual practice in a preferred embodiment MTD is recorded at every foot of length along a particular track. Therefore, the geometric data, in this case curvature data, is simulated or reconstructed at every one-foot interval. The exact measurement unit used is an exemplary unit of reference and should not be considered a limitation of the invention as higher or lower granularity may be observed in certain cases.

It is noted herein that the processing path containing steps 200, 201, and 206 assumes that there is no previously aligned data (ATD) to use as a reference set of data and that the selected track alignment segments (TASs) do meet the geometric constraint criteria. Once step 206 is complete, a track data correction process 209 is performed for the purpose of correcting misalignment (relative shift) to produce correctly aligned data sets that are output at step 210 as aligned measured track data (MTD) analogous to MTD 105*a* described with reference to FIG. 1. It is noted herein in this example that there are 2 other alignment processes that could be utilized according to results of process determinations made in steps 203 and 205. It is also noted herein that steps 203 and 205 may be consolidated as a single step without departing from the spirit and scope of the present invention.

For example, if it is determined at step 203 that there is previously aligned data available that geographically, in a rough sense, matches a selected TAS, then at step 208 a global/local alignment process is performed in place of process 206 using the previously aligned data made available to the process at step 204. Global/Local alignment process 208 is a TDA process option that is described in more detail later in this specification. Essentially, process 208 uses previously aligned track data (ATD) from step 204 (aligned using the Reference Data Reconstruction Alignment Process 206) as a reference data set and cross-correlates raw MTD (101*a* FIG. 1) against this reference data set. One difference in processing however is that another geometric signature instead of curvature data is used to align data. After data is cross-correlated using the global/local alignment process of step 208, at step 209 track data correction is performed as previously described above to adjust or correct any identified shift between location and geometric data in MTD.

In one embodiment of the present invention at step 203 there is no previously aligned data available and at step 205 the TAS does not meet the geometric constraints of the alignment process. In this case a process termed a tangent alignment process is performed instead at step 207. The term tangent is common railroad language used to identify a length of track that is straight, in other words, devoid of curvature. Process 207 performs alignment after all given track measurement data has been roughly aligned against reference data. In step 207 the length of the raw MTD flagged for process 207 is later compared to the length of a corresponding TAS(s). Based on this comparison, a rough estimate of the odometer calibration error is obtained and data is then geographically aligned based on the same. Alternatively, additional track features such as ALDs can also be used for alignment of such data. At step 209 track data correction is performed after tangent alignment at step 207 and the resulting data is output as aligned MTD in step 210.

In one embodiment of the invention all TASs having sufficient curvature data are aligned using reference data reconstruction alignment process 206 by default. This option is exercised particularly in a case where large-scale maintenance has been carried out on the specific track considered. Large-scale maintenance typically results in altered high-frequency information embedded in the recorded data and since comparison based on such high-frequency information is an essential element of granularity in global/local alignment process 208, reference data reconstruction alignment process 206 can be employed in place of process 208. Process 209 (shift correction) is performed regardless of which alignment process 206, 207, or 208 is selected and performed. It is noted herein that processes 206, 207, and 208 are optional sub-processes available as a DTA process 105 described with reference to FIG. 1.

Figure 3:
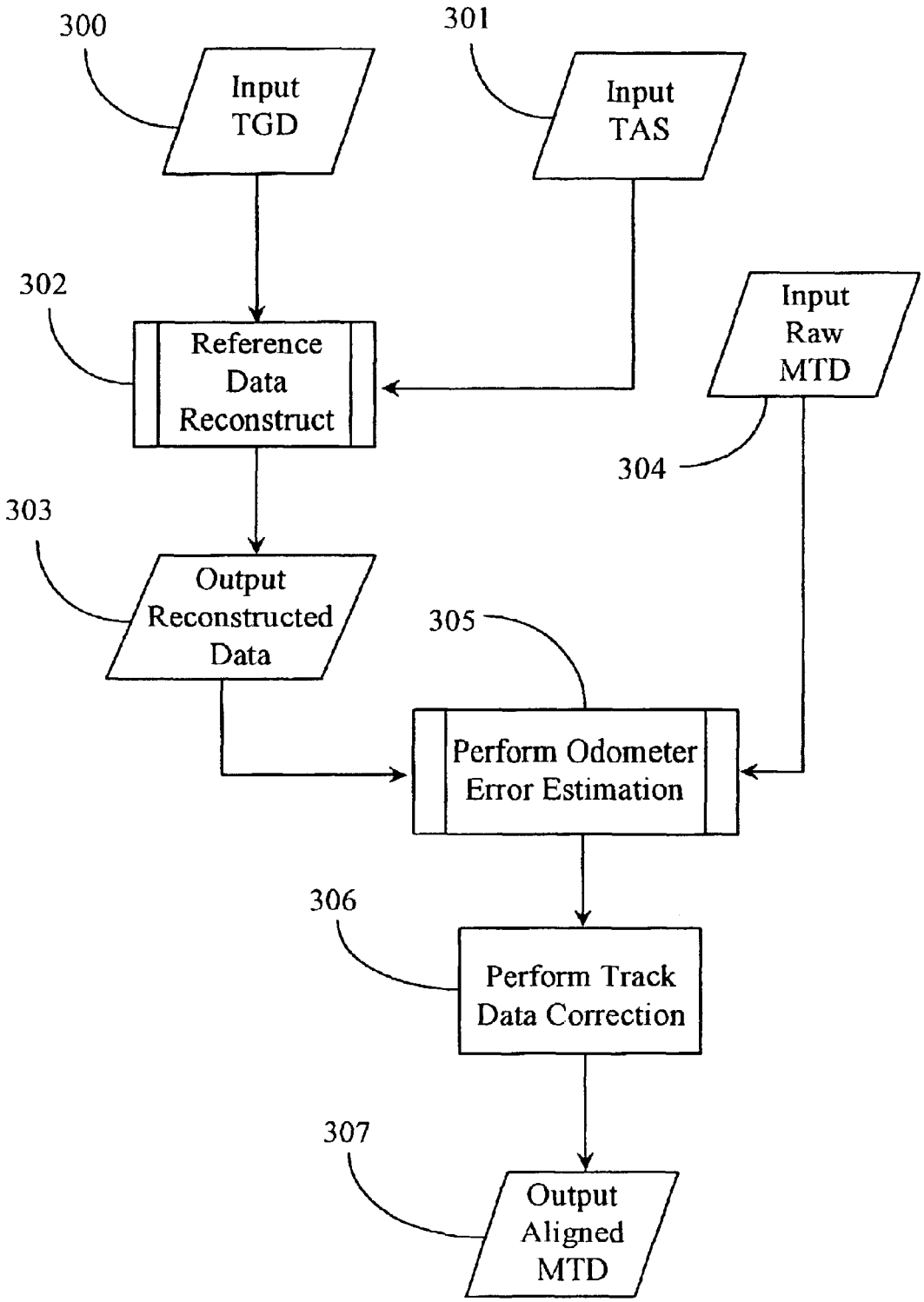
FIG. 3 is a process flow chart illustrating steps for aligning reconstructed reference data according to an embodiment of the present invention.

FIG. 3 is a process flow chart illustrating steps for performing the reference data reconstruction alignment process 206 of FIG. 2 including a sub process 305 for performing odometer error estimation according to an embodiment of the present invention.

The process of reconstructing track geographic data and aligning MTD with the reconstructed data takes into account that odometer error must also be corrected to realize optimally accurate geographic alignment. This example assumes that there is no previously aligned data available for a selected TAS but that the selected TAS meets geometric constraints for processing. At step 300 track layout information or track geography data (TGD) is input for a selected TAS made available as input at step 301. At step 302 the TAS data is reconstructed according to the prescribed granularity. For example, curvature data is rendered in the form of continuous curvature data or a simulated reference set of curvature data at a granularity of every foot of track length, which in this example is the granularity that MTD is typically recorded. Therefore, resulting reconstructed data output at step 303 has simulated curvature values registering at every 1-foot interval of track length.

In one embodiment of the invention process 302 is used even if reconstructed curvature values are not totally sufficient for the stated granularity. In this case if curvature values are not present for a particular curve or portion thereof along a track length having other curves, the fact that track super-elevation and track curvature are interrelated is utilized. Super elevation (Bank Geometry) is a feature implemented along certain curves to offset centripetal forces that act on a vehicle rounding the particular curve containing the feature. In this case an average ratio of track curvature to super-elevation along the same intervals of measurement is obtained for all other identifiable curves present in a particular TAS having valid curvature values. The ratio is then used to calculate an estimated curvature of a particular curve under consideration. If absolutely no curvature data can be estimated or reconstructed for a particular curve, a default value of one degree is assigned to its curvature.

Part of the entire process of TDA is aligning the reconstructed reference data illustrated herein as output at step 303 with raw MTD using cross-correlation to find the relative shift between the data sets, which is an error measure of alignment shift present or a "misalignment" value. This process is represented herein as step 305 and step 306. For example, raw MTD is input at step 304 and at step 305 an odometer error estimation routine is performed. Step 305 refines alignment by taking into account that odometer error can cause increased geographic location error over a significant length of track as was mentioned with respect to the background section of this specification. Process 305 provides a final estimate of calibration error for data correction purposes and is described in more detail later in this specification.

At step 306 the final corrections for misalignment of the MTD and reconstructed track data are performed. At step 307 aligned measured track data (MTD) is output from the process. Aligned MTD in this example is analogous to aligned MTD 105*a* described with reference to FIG. 1. Such aligned data is the measured track data aligned against track geography data with correction for relative shift including shift caused by odometer error. Aligned MTD is stored in a repository analogous to repository 106 described with reference to FIG. 1. This data can be used in further processing as previously aligned data for aligning new measured data over a same track segment.

Iterative Odometer Correction Routine:

In a preferred embodiment, TDA includes a correction method for dealing with relative misalignment between 2 data sets that is caused by odometer error.

Figure 4:
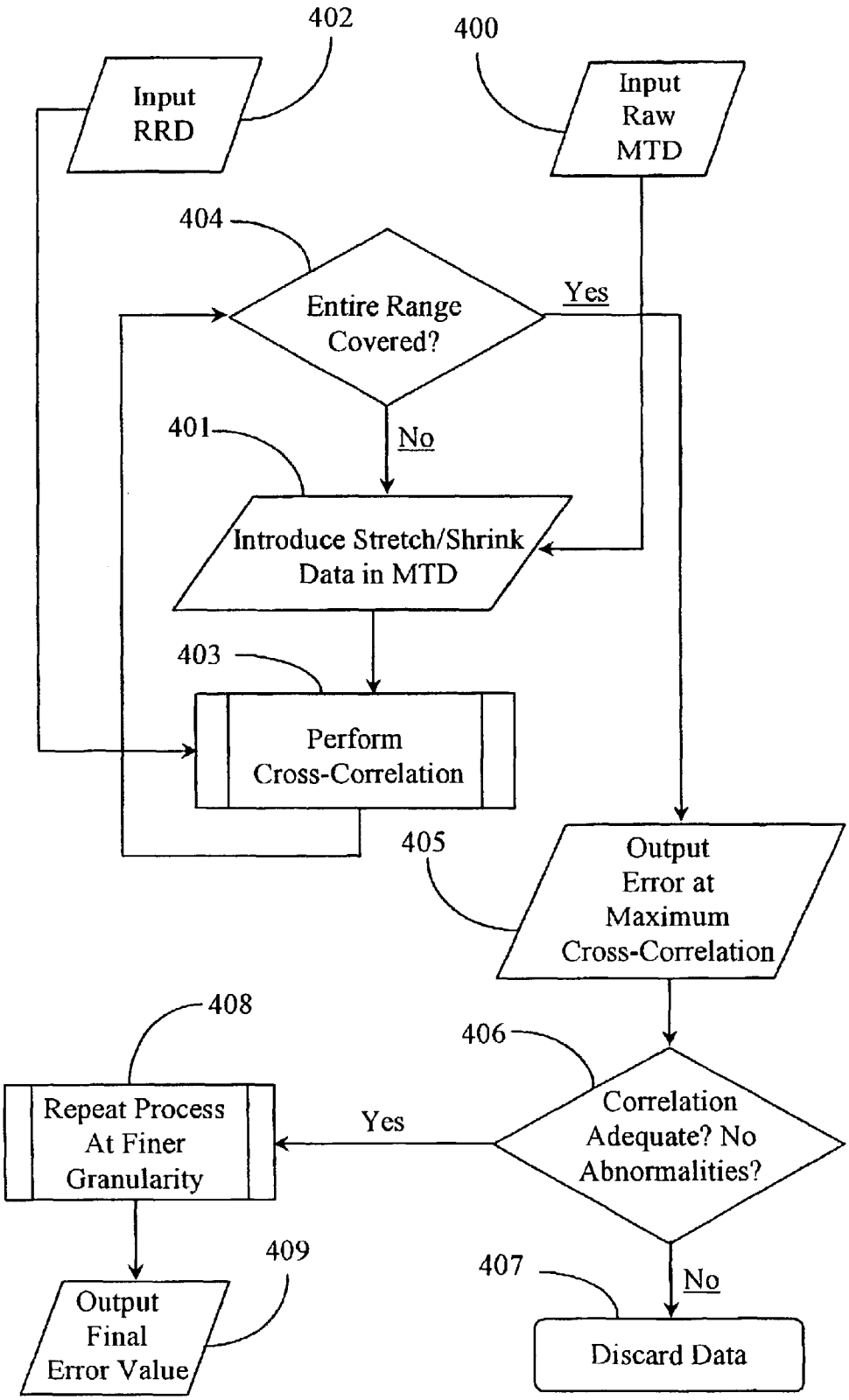
FIG. 4 is a process flow diagram illustrating steps for estimating error of an odometer integrated with the test system according to an embodiment of the present invention.

FIG. 4 is a process flow diagram illustrating sub process steps for performing the odometer error estimation 305 of FIG. 3 according to an embodiment of the present invention. Cross-correlation of data over an entire given length of a particular TAS does not necessarily guarantee acute accuracy of geographic location information within a given track segment. This is because geographic location error can be caused by a poorly calibrated odometer used when recording track-measured data (MTD). It is noted herein as well that if differing vehicles are used in data collection, odometer error rates will also differ between the vehicles.

Errors in odometer calibration cause track measurement data to stretch or shrink with respect to the actual geographic location references contained in data to be aligned. Therefore, even if a part of the data is aligned closely using the relative shift obtained by cross-correlation, there may be portions of the data that may not align accurately when the shift is corrected. Odometer correction attempts to deduce the magnitude and direction of any odometer calibration error that is present in raw MTD through artificial introduction of various amounts of stretching and shrinking in order to, empirically, find a shift value that when corrected produces a best match of the measured data with the reference data. The method assumes that the odometer calibration error does not change significantly over a given length of a particular TAS under consideration.

Referring now back to FIG. 4, at step 400 raw MTD is input into the odometer correction process, which is analogous to the process described as step 305 with reference to FIG. 3. Before any data correlation occurs, MTD is pre-prepared at step 401 through introduction of an artificial stretch or shrinking of data by an n number of feet. In step 401 stretching data is accomplished by repeating a record at uniform intervals, the number of repetitions equal to the number of feet, in this case, that is the predetermined amount of stretching that is introduced. Conversely, shrinking of the data is accomplished by deleting a record at uniform intervals, the number of deletions equal to the number of feet of shrinking that is the predetermined amount to be introduced.

In step 401 stretching the data by n feet is synonymous to a simulated odometer correction of +n feet while shrinking the data by n feet is synonymous to a simulated odometer correction of −n feet. Step 401 is repeated using incremental amounts of stretching and shrinking during the process of odometer correction. At step 402 reconstructed reference data is input into a cross-correlation step 403. At step 403, MTD that has been artificially stretched or shrunk is correlated against reconstructed reference data (RRD) and then analyzed at step 404 for stretch or shrink range present.

With respect to step 401, a maximum limit expressed as notation (MAX_ERROR_CORRECTION) is assigned as the maximum error range that can occur due to odometer calibration. In actual practice, the maximum amount of odometer error plays out to about 50 feet per mile of track. In order to cover a probable range of odometer error the maximum error threshold is set to approximately 200 feet per mile. Therefore, in a segment of MTD covering 10 miles, the maximum stretch and shrink amount (MAX_ERROR) that can be introduced into the process is 2500 feet.

During the entire iterative process of odometer error estimation MTD is subjected to intervals of odometer correction runs that range from the maximum limit for shrinking the data to the maximum limit for stretching the data. This range is expressed in notation as (−MAX_ERROR_CORRECTION to MAX_ERROR_CORRECTION). The above process is repeated at a coarse incremental value expressed in notation as (COARSE_INCREMENT) of every 100 feet of length. Therefore, if the maximum error correction is set to 2500 feet then the values that the data is subjected to in sequential process runs begins at −2500 feet, then −2400 feet until 0 is reached and then +100, +200 until +2500 feet is reached. In other words, the data is cross-correlated against RRD at step 403 for each 100-foot increment of the allowed shrink/stretch maximum range. In this iterative process, the stretched/shrunk raw track measurement data is cross-correlated against the reconstructed reference data as shown in 402, for each value of odometer correction.

During cross-correlation, the maximum limit value placed on possible calibration error covers the entire range of any valid or present actual calibration error in the data. A normalized cross-correlation coefficient value, which is a measure of match between a reference signal (RRD data) and a test signal (MTD data) peaks at the point of range of stretching/shrinking that produces the best estimate of the actual odometer calibration error present in the MTD data. In other words the selected coefficient value defines the strongest linear association between data sets during correlation when the data set having a simulated error most closely matching the actual error is used. It is noted herein that the variation of the cross-correlation coefficient indicating a function of stretching or shrinking introduced in the MTD is not expected to be monotonic, that is, only increasing or only decreasing. An indication of monotonic behavior will cause abortion of the process.

At step 404 it is determined when the entire maximum shrink/stretch range is covered during correlation. If it is determined in step 404 that the entire allowable range h not been covered then more sequences involving steps 401 and 403 are performed until the entire range has been covered. At a point in the process when at step 404 it is determined that the entire error range allowed for the process has been covered, then the error value indicative of the best estimation (most correct error estimation) is output at step 405.

At step 406 it is determined as a check whether the correlation process was thoroughly performed and if there are any abnormalities such as monotonic behavior. If at step 406 either correlation was not adequate and or there are abnormalities detected then the data is discarded and the process begins again using fresh data at step 407. If however, it is determined at step 406 that the correlation runs were adequate and there are no detected abnormalities then at step 408, the entire process is repeated at a finer granularity. A finer granularity may be determined, for example, by processing at every 10 feet of error range instead of at every 100 feet as was used in this example of a coarse run process utilizing a smaller range.

At step 408 a finer increment expressed in notation as (FINE_INCREMENT) run is ordered for a smaller error range selected to cover shift indication. For example, a determined range for a fine increment run can be expressed as (COARSE$_{13}$ CORRECTION−COARSE_INCREMENT) to (COARSE_CORRECTION+COARSE_INCREMENT). In actual practice of the invention, the fine increment is 10 feet as opposed to 100 feet for a coarse run. It is noted herein that the exact increment values decided on for cross correlation purposes can vary in terms of the coarse value of 100 feet and fine value of 10 feet indicated in this example without departing from the spirit and scope of the present invention.

In this present example, if the coarse odometer correction value (COARSE_CORRECTION) were −200 feet for example, then the new values of odometer correction that the data is subjected to in the fine increment run would cover the indicated range at the finer increment. Therefore a suitable range for a fine increment run might begin at −300 to give coverage beyond the reported value (−200) on the minus side and increase by increments of 10 feet, for example, −290, −280, . . . −220, −210, −200, −190, −180, . . . , −120, −110, and end at −100 giving coverage beyond the reported value (−200) on the plus side. Again the process is run in terms of cross correlation for each of the new smaller increments of the smaller range.

The process is the same resulting in a value (FINE_CORRECTION) that indicates the best or peak value of normalized cross-correlation coefficient, which is output as the final estimated error value at step 409. The final value is used to correct odometer error in a data correction process. For example, the valid odometer error value output at step 409 of this example is used in a track data correction process analogous to process 306 described with reference to FIG. 3 above after data is aligned according to relative shift correction.

Referring now back to FIG. 3 process 306, the aligned MTD data is corrected for odometer error by repeating data records at regular intervals in case of shrunk data to account for shift or by deleting data records at regular intervals in case of stretched data. The process avoids data overlaps or data omissions in bulk; avoids interpolation or extrapolation of data including milepost information and other generic information; and thus contributes to preservation of the nature of most of the original data. The aligned MTD is then stored in a data repository analogous to ATDR 106 described with reference to FIG. 1 above.

Global-Local Alignment Process

Referring now back to FIG. 2 it was indicated that if there is already previously aligned data (ATD) available at step 203, then at step 208 a global/local alignment process is performed. More detail about this process including odometer correction is provided below.

Figure 5:
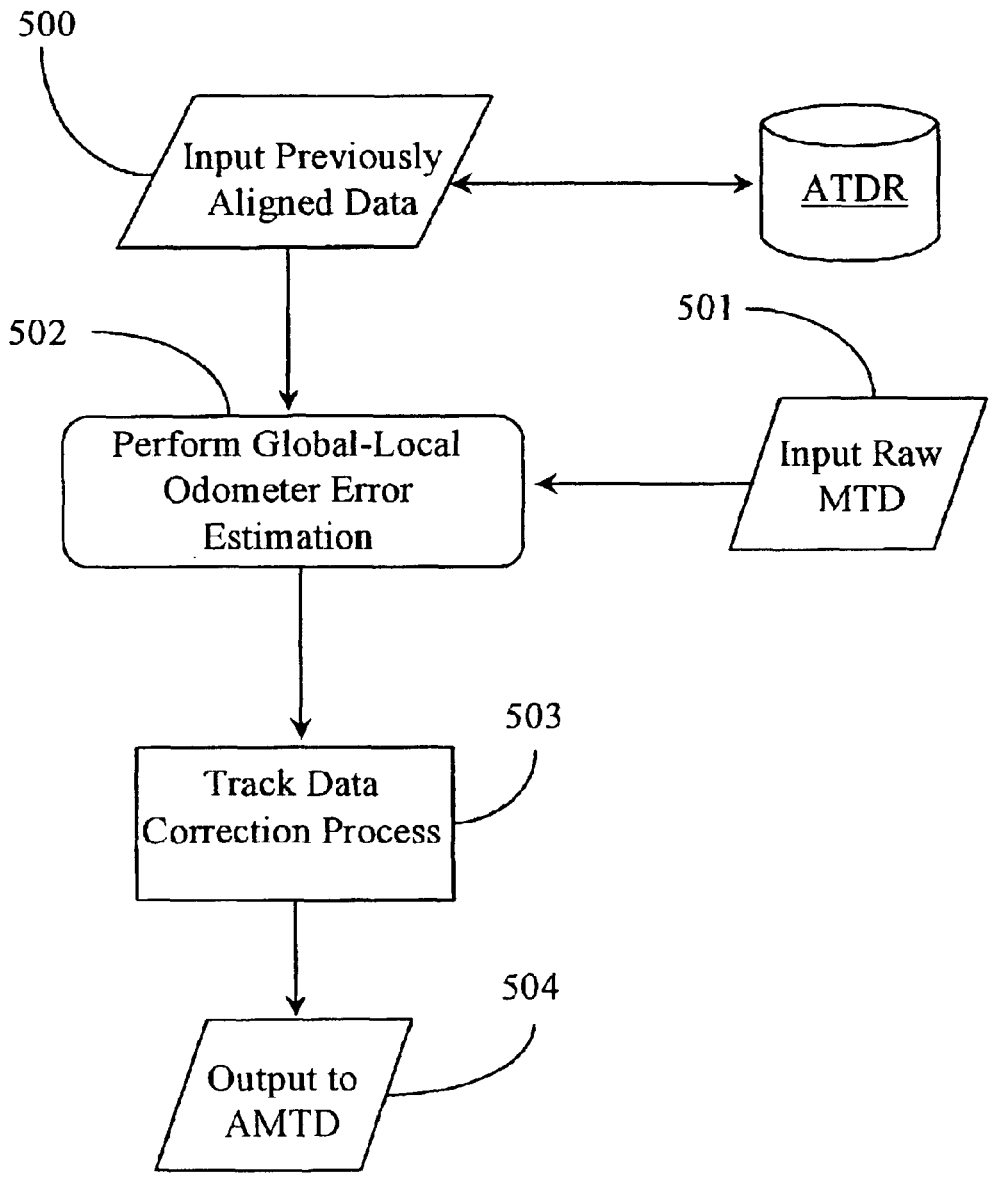
FIG. 5 is a process flow chart illustrating steps for aligning data according to local and global considerations according to an embodiment of the present invention.

FIG. 5 is a process flow chart illustrating steps for aligning data according to global and local considerations in an embodiment of the present invention. At step 500 previously aligned MTD available from a repository (ATDR) analogous to repository 106 of FIG. 1 is provided as input for a global/local alignment process. It is assumed in this step that previously aligned data for a selected TAS for alignment is available as was described with respect to step 203 of the example of FIG. 2 above. The previously aligned data used for this process is data that was aligned using the data reconstruction alignment process analogous to process 206 also described with reference to FIG. 2 above.

The global/local alignment process essentially consists of two separate cross-correlation processes, a global process performed on an entire track segment and a local process performed on segment divisions of the track segment. The global/local alignment process uses previously aligned data input at step 500 as reference data for cross correlation against raw MTD taken from the same length of track at some later date. In a preferred embodiment of the present invention cross-level data (measure of level relationship of left and right tracks taken perpendicularly to track direction) is used as geometric data for alignment purposes because of high frequency of content along a length of track and because of relatively infrequent change in pattern along reasonable lengths. If cross-level comparison does not indicate any correlation between raw MTD and previously aligned MTD, then track gage features (distance between left and right rails) can be used for alignment purposes instead.

Using this approach the raw MTD input at step 501 for the selected TAS is initially aligned in an approximate manner using cross-correlation with the entire reference data set consisting of previously aligned data input at step 500 for the TAS. This preliminary cross-correlation is termed global cross-correlation because one cross correlation process spans the entire segment length. MTD is corrected at step 503 using a measure of misalignment obtained through global cross-correlation.

After performing the global portion of process 502 including step 503, the resulting or "corrected data" and previously aligned data sets are divided into a plurality of smaller portions. Local cross-correlation is then performed separately over these smaller sub-segments and relative shift values are obtained for each of the sub-segments. The procedure is termed local cross-correlation because many shift values are produced and each of those values is "local" to a particular division of the TAS.

An average value is obtained summarizing the variations in the measured relative shifts across the whole length of track considered. This single value is then used to more accurately estimate the odometer calibration error for the TAS. Local cross-correlation is enabled due to a fact that track measurement data MTD retains a signature characteristic to the track structure and vehicle movement across the track, which is also found in the historical track data. As was described above with reference to the process of FIG. 4, it is assumed that the odometer calibration error does not change significantly over the length of the TAS under consideration.

At step 503, a final track data correction process ensues and finished "aligned" data is output to an aligned track data repository (ATDR) at step 504.

Figure 6:
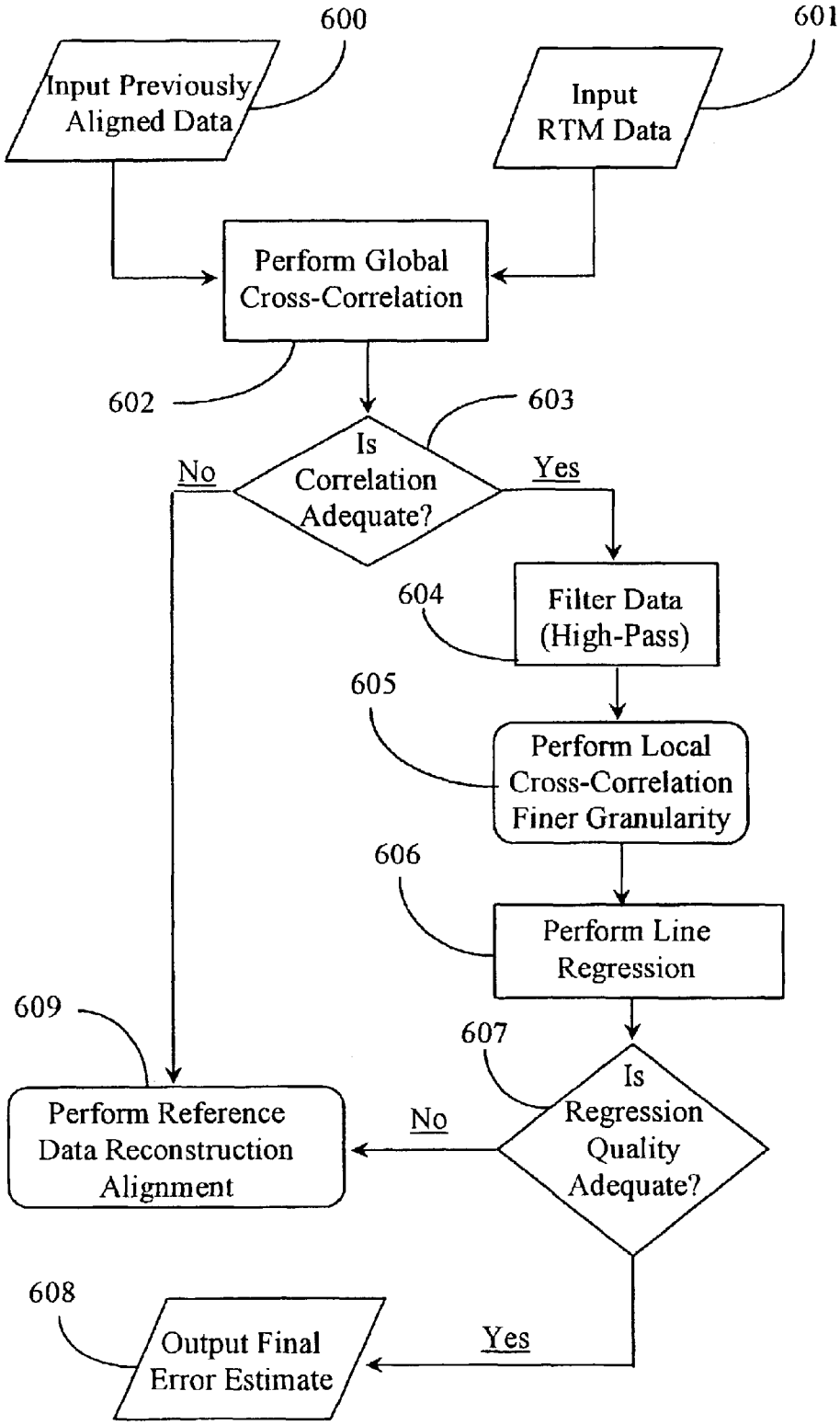
FIG. 6 is a process flow diagram illustrating steps for estimating odometer error using local and global considerations according to an embodiment of the present invention.

FIG. 6 is a process flow diagram further illustrating sub-steps for estimating odometer error using local and global considerations according to an embodiment of the present invention. At step 600 previously aligned data is input into the process. Step 600 is analogous to step 500 described with reference to FIG. 5. As was described above, the previously aligned data was aligned using the reference data reconstruction (RDR) process. At step 601, which is analogous to step 501 of FIG. 5, raw MTD is input into the process for comparison (cross-correlation).

At step 602 global cross-correlation is performed for rough alignment over an entire track segment (TAS). In this step cross-level data is, in a preferred embodiment used for alignment purposes instead of curvature. However this should not be construed as a limitation of the present invention because gage or other geometric criteria can also be used.

At step 603 a determination is made whether the cross-correlation was adequately performed over the entire segment utilizing maximum interval range criteria similar to the odometer calibration process described with reference to FIG. 4 above. If at step 603 it is determined that there is not sufficient correlation then the process reverts back to a reference data reconstruction alignment process at step 508. Step 508 is analogous to step 206 described with reference to FIG. 2 above.

If in step 603 it is determined that cross-correlation is adequate with no abnormalities then at step 604 the data is filtered through a high-pass filter to separate low frequency data from high frequency data. It is noted herein that local cross-correlation focuses on high-frequency data or more particularly cross-level geometry over track length. This is due to a fact that for local cross correlation at finer granularity inclusion of and consideration of curvature data presents step-like data sets, which are more difficult to correlate. Therefore, step 604 exploits a fact that signature of geometric track parameters in previously aligned MTD like cross-level measurements and gage remain relatively constant over track lengths of 5–10 feet when compared with MTD taken at a later date. This is partly attributable to the laying of track as well as movement of trains over the track.

With regard to step 604 then cross-level geometry forms a high frequency component of the data while step-like portions of the data implying presence of partial curves is identified as an undesired low frequency component of the data. Therefore, at step 604 the step-like structure of the data implying partial curves is removed from MTD by high-pass filtering before cross-correlation at step 605. The high frequency track profile is used instead for local cross-correlation in step 605. At step 605 then the TAS is divided into smaller segments of 1000 feet length for local cross-correlation at a finer granularity using only high frequency geometric profile.

During correlation process 605, local measures of misalignment (local shifts) in raw MTD follow a quasi-linear relationship with respect to the previously aligned reference data. This is due to stretching or shrinking of the raw MTD applied during estimation of odometer calibration error. The measures of misalignment identified in step 605 are fitted using a linear regression technique at step 606. The selected line minimizes the sum of squares between real data points plotted in a graph. In this process, the slope of the fitted line provides an estimate of magnitude of odometer calibration error as well as the direction of error.

If a valid odometer correction is obtained and regression quality is determined to be adequate at step 607 then at step 608 a final error estimate is output for correcting the data.

The process resolves to step 503 (track data correction process) described with reference to FIG. 5 above wherein the MTD is corrected using the relative shift and refined using the odometer correction estimate output at step 608. As was previously described above (FIG. 5) MTD is corrected at step 503 by repeating data records at regular intervals in case of shrunk data or by deleting data records at regular intervals in case of stretched data. Following the process of FIG. 5 then the aligned MTD is then output for storage to an aligned track data repository at step 504.

Referring now back to FIG. 6, if regression quality is determined not to be adequate at step 607, in other words, no optimum odometer correction value was obtained, MTD is diverted to a reference data reconstruction process performed at step 609 in order to make a final determination of whether or not the MTD matches the previously aligned reference data. Other sources of location information error such as those produced by incorrect manual entries of track change in MTD can be a source of data misalignment. A track change signature is identified as a succession of increased curvature values with opposite signs indicating transition from a curved track to a parallel track. Errant track change entries are identified and evaluated through detection of the track change signature of the curvature data used in rough alignment. Once evaluated and identified as errors these entries can be eliminated from final processing.

The methods and apparatus of the present invention can be provided in an economic fashion using a common computer platform without relying on previously aligned data or GPS positioning equipment to provide more accurate location information. Data that has been aligned using the methods and apparatus of the invention can be used as reference data for aligning data recorded at later dates of the same length of track.

It will be apparent to one with skill in the art that as an integrated data alignment process, the overall method of the present invention includes correction of odometer error introduced into recorded test data using automation producing the most optimum data results possible. The methods and apparatus of the present invention are flexible and useable in different embodiments and should therefore be afforded the broadest possible scope under examination. The methods and apparatus of the invention are limited only be the claims that follow.

What is claimed is:

1. A computerized system for aligning measured track data collected from a length of railroad track to correct geographic location information for geometric features contained in the data comprising:

a first data repository containing track geography data;

a second data repository containing the measured track data; and a processing component for comparing the measured tack data to the track geography data;

characterized in that the track geography data is reconstructed to match in format and track length to the measured track data and then cross-correlated reference data to the measured track data, the cross correlation made in whole and or in matching portions thereof for purpose of identifying shift in alignment between the data types, the shift relating to misalignment of geometric and geographic signatures present in both data types including shift identified as odometer error value in the measured track data, the identified shifts used to correct geometric, geographic, and odometer error misalignment in the measured track data with respect to the reference data.

2. The system of claim 1 maintained in and accessible from a track-geometry test vehicle.

3. The system of claim 1 maintained externally from but accessible in part to a track-geometry test vehicle.

4. The system of claim 1 wherein the geometric data used for alignment comprises one or a combination of curvature data, cross-level data, gage data, super-elevation data, rail twist data, and rough feature location information.

5. The system of claim 1 wherein the track geography data is available from and taken from a known Railway Information System data repository.

6. The system of claim 1 wherein the measured track data after shift correction is subsequently used as previously aligned data for reference used in further alignment of data recorded at a later date over the same track length.

7. The system of claim 1 wherein data reconstruction of the track geography data includes data reformatting to simulate the data format of the measured track data.

8. The system of claim 7 wherein data reconstruction construction of the track geography data includes segmentation to produce segments of track geography data representing data occurring over a specified track length.

9. The system of claim 1 wherein shift in alignment due to odometer error is identified through linear regression.

10. A method for aligning measured track data collected from a railroad track to correct geographic location information for geometric parameters in the measured track data comprising steps of:

(a) obtaining track geography data for use as reference data in data alignment;

(b) reconstructing the track geography data to simulate in form and in coverage of length the measured track data to be aligned;

(c) cross-correlating the reconstructed reference data to the measured track data to identify a relative misalignment value between the data types; and (d) using the value identified through comparison to correct the geographic location information contained in the measured track data.

11. The method of claim 10 wherein in step (a) the track geography data is available from and taken from a known Railway Information System data repository.

12. The method of claim 10 wherein in step (a) the track geography data contains feature location information and at least some if not all data types describing curvature data, cross-level data, gage data, and super-elevation data.

13. The method of claim 10 wherein in step (b) the track geography data is reconstructed to produce segments of track geography data representing data occurring over a specified track length including geometric data of features and feature location information located along she specified length.

14. The method of claim 10 wherein in step (c) primary parameter to be compared is curvature data.

15. The method of claim 10 wherein step (c) the primary parameter to be compared is super-elevation.

16. The method of claim 10 wherein in step (c) the primary parameter to be compared is cross-level measurement.

17. The method of claim 10, wherein in step (c) the primary parameter to be compared is gage measurement.

18. The method of claim 10 wherein in step (b) the track geography data lacks curvature information of curves contained therein and the reconstruction thereof uses the ratio between super-elevation and curvature data to predict type direction and magnitude of curves.

19. The method of claim 10 wherein in step (b) track geography data is divided into segments of pre-determined track lengths using a constrained optimization algorithm wherein the total length of segments not satisfying geometric constraints is minimized over a length of track for alignment consideration.

20. In a data alignment process for aligning measured track data collected along a length of railroad track to a reference data set for the same length of track, a method for coarse estimation of odometer error manifest along the track length of measured track data and refining the coarse estimate to produce a final estimate used in correcting the actual odometer error manifest in the measured track data comprising steps of:

(a) creating a plurality of simulated data sets from the measured track data, each data set simulating a different odometer error value, each value taken at a different predetermined interval point along a predetermined maximum error range applied to the measured track data set, the range having a zero interval point at center thereof;

(b) cross-correlating each of the simulated data sets against the reference data set at each interval point along the maximum range allowed obtaining a coefficient value for each of the simulated data sets;

(c) identifying a single best coefficient value from those obtained in step (b) that defines a best alignment to data contained in the reference data set; and (d) repeating steps (a) through (c) using a smaller range having smaller intervals, the smaller range centered over the range interval in the first range of the measured track data associated the best coefficient identified.

21. The method of claim 20 wherein in step (a) the error shifts are created by shrinking the measured track data to produce shift intervals along the negative side of the range and stretching the data to produce shift intervals along the positive side of the range.

22. The method of claim 21 wherein in step (a) shrinking the measured track data is accomplished by deleting a record from the data at uniform intervals a number of times until a desired amount of shrinking is produced and stretching the measured track data is accomplished by duplicating a record in the data at uniform intervals a number of times until a desired amount of stretching is produced.

23. The method of claim 20 wherein in step (a) the maximum shift range exceeds maximum odometer error manifestation possible for the specified length of the track measured.

24. The method of claim 20 wherein in step (b) the coefficient values define linear association strength between correlating interval points along the range.

25. The method of claim 21 wherein in step (c) the single coefficient value produces a coarse odometer error values.

26. The method of claim 20 wherein in step (d) the best coefficient found after correlating all of the simulated data sets of the smaller range intervals against the reference data set produces a final odometer error estimate for the measured track data set.

27. In a data alignment process for aligning measured track data collected along a length of railroad track to a reference data set for the same length of track, a method for estimating a value of odometer error manifest along the track length of measured track data comprising steps of:

(a) cross-correlating the entire set of measured track data to the entire set of reference data to identify a relative misalignment value;

(b) filtering the measured track data set to remove references to certain geometric features;

(c) dividing the length of the measured and reference data sets into smaller portions;

(d) cross-correlating the smaller portions of measured data against associated portions of reference data to find relative misalignment values for each portion;

(e) using line regression, fitting a line through the found misalignment values plotted sequentially for each correlated data portion on a graph; and (f) determining the magnitude and direction of slope of the fitted line indicative of the magnitude and direction of the actual calibration error manifest in the measured track data.

28. The method of claim 27 wherein in step (a) the reference data comprises previously aligned measured track data aligned to track geography data as reference data.

29. The method of claim 27 wherein in step (a) geometric features and location information contained in both data sets are used to align the data sets.

30. The method of claim 27 wherein in step (b) the geometric data references removed describe curvature data and those retained describe one or both of cross-level features and gage measurement features.

31. The method of claim 28 wherein in step (d) the geometric parameter for alignment is cross-level measurement.

32. The method of claim 28 wherein in step (d) the geometric parameter for alignment is gage measurement.

33. The method of claim 28 wherein steps (a) through (f) are carried out in batch mode using multiple measured track data sets as input and a same previously aligned data set as reference data for a same length of track, each measured track data set collected at different test runs performed at different times.

* * * * *

UNITED STATES PATENT AND TRADEMARK OFFICE

CERTIFICATE OF CORRECTION

PATENT NO. : 6,804,621 B1
DATED : October 12, 2004
INVENTOR(S) : Niranjan Ramesh Pedanekar It is certified that error appears in the above-identified patent and that said Letters Patent is hereby corrected as shown below:

Title page,
Item [75], Inventor, now reads "Niranjan Ramesh Pedanckar"
should read -- Niranjan Ramesh Pedanekar --

Signed and Sealed this

Nineteenth Day of July, 2005

JON W. DUDAS
*Director of the United States Patent and Trademark Office*